United States Patent [19]

Rave

[11] 4,154,646

[45] May 15, 1979

[54] PREPARATION OF HYDROPHILIC STYRENE MALEIC ANHYDRIDE COPOLYMER FIBERS FOR USE IN PAPERMAKING

[75] Inventor: Terence W. Rave, Wilmington, Del.

[73] Assignee: Hercules Incorporated, Wilmington, Del.

[21] Appl. No.: 818,046

[22] Filed: Jul. 22, 1977

[51] Int. Cl.[2] ..... D21H 5/12

[52] U.S. Cl. ..... 162/157 R; 162/146; 162/164 R; 162/164 EP; 162/166; 162/168 R; 162/168 N; 162/168 NA; 162/182; 427/221; 427/444

[58] Field of Search ..... 260/29.2 EP, 29.2 N, 260/29.6 H, 29.6 NR; 428/394, 395; 427/444, 221; 162/146, 157 R, 164 R, 164 EP, 166, 168 N, 168 R, 168 NA, 182, 167

[56] References Cited

U.S. PATENT DOCUMENTS

| | | | |
|---|---|---|---|
| 2,595,935 | 5/1952 | Daniel et al. | 162/164 EP |
| 2,601,597 | 6/1952 | Daniel et al. | 162/164 R |
| 2,926,116 | 2/1960 | Keim | 162/164 EP |
| 2,926,154 | 2/1960 | Keim | 162/164 EP |
| 3,240,664 | 3/1966 | Earle | 162/164 EP |
| 3,556,932 | 1/1971 | Coscia et al. | 162/168 NA |
| 3,677,888 | 7/1972 | Economou | 162/168 NA |
| 3,700,623 | 10/1972 | Keim | 162/168 N |
| 3,743,570 | 7/1973 | Yang et al. | 162/157 R |
| 3,816,556 | 6/1974 | Roscia et al. | 162/168 NA |

FOREIGN PATENT DOCUMENTS 2413922 10/1974 Fed. Rep. of Germany.

*Primary Examiner*—S. Leon Bashore
*Assistant Examiner*—Peter Chin
*Attorney, Agent, or Firm*—John W. Whitson

[57] ABSTRACT

Hydrophilic fibers may be prepared by discharging a heated and pressurized dispersion of a styrene-maleic anhydride copolymer into a zone of reduced temperature and pressure, and then modifying the fibers so produced by treatment with an aqueous admixture of selected cationic and anionic water-soluble, nitrogen-containing polymers. Blends of the hydrophilic fibers with wood pulp provide paper products having improved physical properties.

7 Claims, No Drawings

PREPARATION OF HYDROPHILIC STYRENE MALEIC ANHYDRIDE COPOLYMER FIBERS FOR USE IN PAPERMAKING

This invention relates to a process for the preparation of hydrophilic synthetic polymer fibers which are readily dispersible in water and which can be blended with wood pulp fibers to provide a pulp which can be made into high quality paper using conventional papermaking techniques. More particularly, the invention relates to the formation of fibers from a styrene-maleic anhydride copolymer and treatment of these fibers with blends of certain water-soluble, nitrogen-containing polymers, one of which is cationic and the other of which is anionic.

In recent years, a considerable amount of effort has been expended in the development of fibrous synthetic pulps having hydrophilic properties. Much of the effort has been with polyolefins. For example, according to U.S. Pat. No. 3,743,570 to Yang et al, assigned to Crown Zellerbach Corporation, polyolefin fibers having a high surface area are treated with a hydrophilic colloidal polymeric additive composed of a cationic polymer such as melamine-formaldehyde and an anionic polymer such as carboxymethyl cellulose. Hydrophilic polyolefin pulps also have been prepared by dispersing a polyolefin and a hydrophilic additive, such as polyvinyl alcohol or a hydrophilic clay, in a liquid which is not a solvent for either component at its normal boiling point, heating the resulting dispersion at superatmospheric pressure to dissolve the polymer and any solvent-soluble additive, and then spurting the resulting composition into a zone of reduced temperature and pressure to form a fibrous product. Using the spurting procedure, Toray Industries Inc. have disclosed in their German application No. 413,922, filed Mar. 22, 1974 and published Oct. 17, 1974 as No. 2,413,922, the preparation of anionic pulps from mixtures of polyolefins and copolymers of olefinic compounds with maleic anhydride or acrylic or methacrylic acids. Blends of these pulps with wood pulp have provided paper with better tensile strength than paper made without the copolymer component.

Now in accordance with this invention, it has been found that paper having further improved strength properties can be prepared by forming a spurted fibrous anionic pulp from a styrene-maleic anhydride copolymer and then modifying this fibrous product by disc refining the fibers in a dilute aqueous solution or dispersion of a blend of a certain type of cationic, water-soluble, nitrogen-containing polymer and a certain type of anionic, water-soluble, nitrogen-containing polymer. The fiber modifying step of the process of this invention results in deposition of the blend of cationic and anionic nitrogen-containing polymers on the spurted fibers, and the original anionic fibers are converted into modified fibers which are capable of bonding to the cellulosic fibers of wood pulp.

As an example of the process of this invention, a styrene-maleic anhydride copolymer is dispersed in a mixture of hexane and water, and the dispersion is heated in a closed system to a temperature of about 220° C. Under these conditions, the pressure generated by the hexane and water vapors is of the order of 500 p.s.i. After introducing nitrogen to increase the vapor pressure of the system to a pressure of about 1000 p.s.i., the contents of the system are vented to the atmosphere through an orifice, resulting in evaporation of the water and the hexane solvent and formation of the fiber product. The fiber product then is suspended in an aqueous medium formed by blending a dilute aqueous solution of, for example, epichlorohydrin-modified poly(diethylenetriamine-adipic acid) with a dilute aqueous solution of, for example, glyoxal-modified poly(acrylamide-co-arcylic acid), and the components of the resulting suspension are brought into intimate contact with each other by refining in a disc refiner. The treated fibers may then be isolated and stored in wet cake form, or the suspension containing the fibers may be used directly in a papermaking process.

Having generally outlined the embodiments of this invention, the following examples constitute specific illustrations thereof. All amounts are based on parts by weight.

EXAMPLE A

A cationic, water-soluble, nitrogen-containing polymer was prepared from diethylenetriamine, adipic acid and epichlorohydrin. Diethylenetriamine in the amount of 0.97 mole was added to a reaction vessel equipped with a mechanical stirrer, a thermometer and a reflux condenser. There then was gradually added to the reaction vessel one mole of adipic acid with stirring. After the acid had dissolved in the amine, the reaction mixture was heated to 170°–175° C. and held at that temperature for one and one-half hours, at which time the reaction mixture had become very viscous. The reaction mixture then was cooled to 140° C., and sufficient water was added to provide the resulting polyamide solution with a solids content of about 50%. A sample of the polyamide isolated from this solution was found to have a reduced specific viscosity of 0.155 deciliters per gram when measured at a concentration of two percent in a one molar aqueous solution of ammonium chloride. The polyamide solution was diluted to 13.5% solids and heated to 40° C., and epichlorohydrin was slowly added in an amount corresponding to 1.32 moles per mole of secondary amine in the polyamide. The reaction mixture then was heated at a temperature between 70° and 75° C. until it attained a Gardner viscosity of E-F. Sufficient water next was added to provide a solids content of about 12.5%, and the solution was cooled to 25° C. The pH of the solution then was adjusted to 4.7 with concentrated sulfuric acid. The final product obtained 12.5% solids and had a Gardner viscosity of B-C.

EXAMPLE B

Another representative cationic, water-soluble, nitrogen-containing polymer was prepared, this time using epichlorohydrin and a commercially available liquid mixture of polyamines as the reactant. This mixture contained at least 75% of bis(hexamethylene)triamine and higher homologues, the remainder of the mixture consisting of lower molecular weight amines, nitriles and lactams. The reaction was carried out in a kettle fitted with a steam jet vacuum system used to exhaust vapors through a condenser instead of permitting them to escape through an open port in the kettle.

The kettle was charged with 704 parts of water and 476 parts of epichlorohydrin, and then 240 parts of the commercial mixture of polyamines was added to the kettle over a period of 35 minutes, the reaction mixture being cooled to prevent the temperature from exceeding 70° C. After addition of the amine, six parts of aqueous 20% sodium hydroxide was added to accelerate the reaction and, after a total of 160 minutes at about 70° C., the reaction mixture was diluted with 640 parts of water to reduce the viscosity to a Gardner value of about C. A total of 44 parts of aqueous 20% sodium hydroxide then was added over a peroid of 105 minutes. A Gardner viscosity of S was reached after 215 minutes, at which point the reaction was termined by the addition of 26 parts of concentrated sulfuric acid dissolved in 1345 parts of water. The resulting solution had a Gardner viscosity of D, and additional sulfuric acid and water were added to adjust the pH to 4 and provide a solids content of 22.5%.

EXAMPLE C

A further cationic, water-soluble, nitrogen-containing polymer was prepared, the basic reactants being methyldiallylamine and epichlorohydrin. To 333 parts of methyldiallylamine was slowly added 290–295 parts of concentrated hydrochloric acid to provide a solution having a pH of 3 to 4. Th solution then was sparged with nitrogen for 20 minutes and the temperature was adjusted to 50° to 60° C. An aqueous 10.7% solution of sodium bisulfite and an aqueous 10.1% solution of t-butyl hydroperoxide were simultaneously added to the reaction mixture over a period of four to five hours until the resulting polymer, poly(methyldiallylamine hydrochloride), had a reduced specific viscosity of 0.2 as measured on a one percent solution in aqueous one molar sodium chloride at 25° C. The amount of each of the sodium bisulfite and the t-butyl hydroperoxide used was two mole percent based on the polymer repeat units.

To the above polymer solution there then was added 600 parts of aqueous four percent sodium hydroxide, and the temperature of the resulting solution was adjusted to 35° C. After addition of sufficient water to bring the solids content of the polymer solution to 22%, there was added 416.3 parts of epichlorohydrin. The temperature of the reaction mixture was maintained at about 45° C. while the Gardner viscosity of the mixture increased from less than A to B+. After the addition of about 304 parts of 36% hydrochloric acid, the reaction mixture was heated to 80° C. and maintained at this temperature with continual addition of further amounts of hydrochloric acid until the pH of the reaction mixture had stabilized at 2 for one hour. The reaction mixture then was cooled to 40° C., adjusted to a pH of 3.5–4.0 with aqueous four percent sodium hydroxide and diluted to 20% solids.

The resin product from the above process, prior to use in accordance with this invention, must be base activated. This is accomplished by adding 18 parts of water and 12 parts of one molar sodium hydroxide solution to each 10 parts of the 20% solids solution of the resin. The resulting five percent solids solution, after aging for 15 minutes, should have a pH of 10 or higher. Additional sodium hydroxide should be added, if necessary, to obtain this level of pH.

EXAMPLE D

Another useful cationic, water-soluble, nitrogen-containing polymer was prepared from bis(3-aminopropyl)-methylamine, urea and epichlorhydrin. Two hundred ten parts of the amine and 87 parts of urea were placed in a reaction vessel, heated to 175° C., held at this temperature for one hour and then cooled to 155° C. Water was added to the reaction product in the amount of 375 parts, and the resulting solution was cooled to room temperature.

To 271 parts of the above solution was added 321 parts of water, 29 parts of concentrated hydrochloric acid and 89.6 parts of epichlorohydrin. The temperature of the reaction mixture was maintained in the range of 39° to 42° C. for about 85 minutes while the Gardner viscosity of the mixture increased from A-B to L+. There then was added to the mixture 60 parts of concentrated hydrochloric acid, and the resulting mixture was heated for four hours at a temperature in the range of 60° to 75° C., nine more parts of hydrochloric acid being added after about one and one-half hours to keep the pH below 2. The mixture then was cooled to room temperature. The resulting epichlorohydrin-modified polyaminourylene product contained 27% solids.

The above product, prior to use in accordance with this invention, also must be base activated. Activation is accomplished by adding ten parts of the above product to 10 parts of one molar sodium hydroxide solution, aging the resulting solution for 15 minutes, and then diluting the solution (13.5% solids) to five percent solids or less for use.

EXAMPLE E

An anionic, water-soluble, nitrogen-containing polymer was prepared from acrylamide, acrylic acid and glyoxal. To a reaction vessel equipped with a mechanical stirrer, a thermometer, a reflux condenser and a nitrogen adapter was added 890 parts of water. There then was dissolved in the water 98 parts of acrylamide, two parts of acrylic acid and one and one-half parts of aqueous 10% cupric sulfate. The resulting solution was sparged with nitrogen and heated to 76° C., at which point two parts of ammonium persulfate dissolved in six and one-half parts of water was added. The temperature of the reaction mixture increased 21.5° C. over a period of three minutes following addition of the persulfate. When the temperature returned to 76° C., it was maintained there for two hours, after which the reaction mixture was cooled to room temperature. The resulting solution had a Brookfield viscosity of 54 centipoises at 21° C. and contained less than 0.2% acrylamide based on the polymer content.

To 766.9 parts of the above solution (76.7 parts of polymer containing 75.2 parts, or 1.06 mole, of amide repeat units) was added 39.1 parts of aqueous 40% glyoxal (15.64 parts, or 0.255 equivalent based on amide repeat units, of glyoxal). The pH of the resulting solution was adjusted to 9.25 by the addition of 111.3 parts of aqueous 2% sodium hydroxide. Within approximately 20 minutes after addition of the sodium hyroxide, the Gardner viscosity of the solution had increased from A to E. The reaction was then terminated by the addition of 2777 parts of water and about two and six-tenths parts of aqueous 40% sulfuric acid. The resulting solution had a pH of 4.4 and contained 2.2% solids.

EXAMPLE F

Another representative anionic, water-soluble, nitrogen-contaning polymer was prepared using only acrylamide and glyoxal as reactants. In a reaction vessel equipped with a stirrer, a thermometer and a reflux condenser, there was placed 350 parts of acrylamide, one part of phenyl-$\beta$-naphthylamine and 3870 parts of chlorobenzene. This mixture was heated to 80° to 90° C. with vigorous stirring to partially melt and partially dissolve the acrylamide. One part sodium hydroxide flake then was added to the mixture and, after an induction period, an exothermic reaction occurred and there was separation of polymer on the stirrer and on the walls of the reaction vessel. Three more one-part charges of sodium hydroxide flake was added to the reaction mixture at thirty-minute intervals, following which the reaction mixture was heated at about 90° C. for one hour. The hot chlorobenzene then was decanted, and the residual solid, a branched, water-soluble poly(β-alanine), was washed three times with acetone and subsequently dissolved at room temperature in 1000 parts of water. The cloudy solution so obtained, having a pH of about 10.5, was heated at about 75° C. for about 30 minutes to effect partial hydrolysis of the amide groups in the poly(β-alanine), and live steam was blown through the solution until the residual chlorobenzne had been removed and the last traces of polymer had dissolved. After cooling, the solution was adjusted to a pH of about 5.5 with sulfuric acid. The dissolved polymer contained about two mole percent carboxyl groups, as determined by potentiometric titration.

To an aqueous 15% solution of the above polymer was added an aqueous 40% solution of glyoxal in an amount sufficient to provide 25 mole percent of glyoxal based on the amide repeat units in the polymer. The pH of the resulting solution was slowly raised to about 9.0 to 9.5 at room temperature by the addition of dilute aqueous sodium hydroxide, and the pH was maintained at this level until an increase in Gardner viscosity of five to six units had occurred. The solution then was quickly diluted with water to 10% total solids and adjusted to a pH of 5.0 with sulfuric acid.

EXAMPLE 1

One hundred parts of a styrene-maleic anhydride copolymer (Arco/Polymers, Inc. 92:8 styrene:maleic anhydride, molecular weight 220,000) was charged to a closed autoclave along with 250 parts of hexane and 250 parts of water. The contents of the autoclave were stirred and heated to 220° C., at which point the vapor pressure in the autoclave was raised to 1000 p.s.i. by the introduction of nitrogen. The resulting emulsion was spurted from the autoclave into the atmosphere through an orifice having a diameter of one millimeter and a length of one millimeter, resulting in formation of the desired fiber product. Portions of the fiber product then were disc refined for six minutes in a Sprout Waldron disc refiner at 0.25% consistency in (a) water and (b) an aqueous medium containing 0.1% of a blend of a cationic polymer prepared according to Example A and an anionic polymer prepared according to Example E, the weight ratio of the cationic polymer to anionic polymer in the resin blend being 1:5. The refined fiber product (b), after washing with water, contained 9.3% of attached resin based on nitrogen analysis.

EXAMPLE 2

The spurted fiber product of Example 1 was disc refined as in that example except that an aqueous medium containing 0.05% of the blend of cationic and anionic polymers was used. The refined fiber product, after washing with water, contained 5.0% attached resin based on nitrogen analysis.

EXAMPLES 3 AND 4

Repetition of Example 2 was effected under identical conditions except for use of a 1:7 weight ratio of the cationic polymer to the anionic polymer in the resin blend in Example 3 and a 1:3 weight ratio of the polymers in Example 4. The resin pick-up in the fiber product of Example 3 was 4.5% and was 5.3% in the fiber product of Example 4.

EXAMPLE 5

Each of the synthetic pulps prepared as described in Examples 1 to 4 was blended with bleached kraft wood pulp (50:50 RBK:WBK, pH 6.5, 500 Canadian Standard Freeness) in the ratio of 30% synthetic pulp to 70% wood pulp. Handsheets prepared from the blends were dried and calendered at 500 lbs./linear inch at 60° C. The brightness, opacity, tensile strength and Mullen burst strength of the calendered sheets were determined, and the results are given in Table 1. In the data given in this table, the tensile strength and Mullen burst strength values are expressed as a percentage of the tensile strength and Mullen burst strength of the 100% wood pulp control, all being corrected to a 40 pound per ream basis weight.

Table 1

| Example | Brightness (%) | Opacity (%) | Tensile Strength (%) | Mullen Burst Strength (%) |
|---|---|---|---|---|
| 1(a) | 88 | 88 | 72 | 64 |
| 1(b) | 88 | 88 | 92 | 84 |
| 2 | 88 | 88 | 84 | 79 |
| 3 | 88 | 89 | 84 | 80 |
| 4 | 88 | 88 | 85 | 82 |

It is apparent from the above data that the process of this invention can provide paper having from about 85 to about 90% of the tensile strength and from about 80 to about 85% of the Mullen burst strength of a paper prepared from 100% wood pulp.

EXAMPLE 6

The procedure of Example 1 was followed in preparing a fiber product which was disc refined, as in Example 1, in an aqueous medium containing 0.1% of a blend of a cationic polymer prepared according to Example A and an anionic polymer prepared according to Example F, the ratio of cationic:anionic being 1:3 by weight, resulting in fibers containing 8.1% of deposited resin. The refined pulp was blended with wood pulp and handsheets were prepared and evaluated, as in Example 5. The resulting sheets exhibited 87% brightness, 87% opacity and 92% tensile strength.

EXAMPLE 7

A fiber product was prepared following the procedure of Example 1, and separate portions of the product were disc refined, as in that example, in aqueous media containing 0.1% of (a) a blend of a cationic polymer prepared according to Example B with an anionic polymer prepared according to Example E, the ratio of cationic:anionic being 1:5 by weight, (b) a blend of a cationic polymer prepared according to Example C with an anionic polymer prepared according to Example E, the cationic:anionic ratio being 1:5 by weight, and (c) a blend of a cationic polymer prepared according to Example D with an anionic polymer prepared according to Example E, the ratio of cationic:anionic being 1:5 by weight. The refined pulps were blended with wood pulp and handsheets were prepared and evalated as described in Example 5. The results are given in Table 2.

Table 2

| Additive | Brightness (%) | Opacity (%) | Tensile Strength (%) |
|---|---|---|---|
| (a) | 88 | 88 | 91 |
| (b) | 88 | 88 | 95 |
| (c) | 88 | 88 | 90 |

EXAMPLE 8

The fiber preparation of Example 1 was duplicated except for use of a styrene-maleic anhydride copolymer in which the styrene:maleic anhydride ratio was 4:1. The fiber product was then disc refined as in Example 1 using the aqueous resin blend specified therein. The refined fibers contained 7.5% of deposited resin based on nitrogen analysis. Handsheets were prepared and evaluated in accordance with Example 5. They exhibited 88% brightness, 89% opacity and 86% tensile strength.

Comparative data obtained from the evaluation of representative prior art polymeric additives are shown in the following example. All amounts again are based on parts by weight.

EXAMPLE 9

A fiber product was prepared as described in Example 1, and separate portions of the fiber product were disc refined, as in Example 1, in aqueous medium containing 0.1% of (a) the resin blend of Example 1, (b) a 1:1 blend of melamine-formaldehyde polymer (Paramel HE, American Cyanamid) and carboxymethyl cellulose (CMC, D.S. 0.4, Hercules), (c) a 2:1 blend of the Paramel and CMC polymers, (d) glyoxal-modified poly(acrylamide-co-diallyl-dimethylammonium chloride) (Parez 631 NC, American Cyanamid), (e) cationic starch, (f) the cationic polymer of Example A, and (g) the anionic polymer of Example E. Each of the resulting pulps was blended with wood pulp, and handsheets were prepared and evaluated, all as described in Example 5. The results are shown in Table 3.

Table 3

| Additive | Brightness (%) | Opacity (%) | Tensile Strength (%) |
|---|---|---|---|
| (a) | 88 | 88 | 93 |
| (b) | 88 | 89 | 74 |
| (c) | 89 | 88 | 75 |
| (d) | 87 | 88 | 73 |
| (e) | 89 | 87 | 73 |
| (f) | 88 | 89 | 74 |
| (g) | 89 | 88 | 72 |

These data show that the replacement of resin blend (a) by known blends (b) and (c) and by individual additives (d), (e), (f) and (g) in the process of this invention does not provide a paper having the highly desirable, superior tensile strength of the paper produced using resin blend (a).

The anionic pulp used in the process of this invention is prepared by spurting certain copolymers of styrene and maleic anhydride. These copolymers obviously must have fiber-forming properties, consequently the preferred copolymers are those having a molecular weight in the range of from about 10,000 to about 300,000, preferably from about 50,000 to about 200,000. The styrene-maleic anhydride copolymers also must contain sufficient carboxylic functionality to render the corresponding fibers hydrophilic and to be effective with the blend of cationic and anionic water-soluble, nitrogen-containing polymers used to modify the fibers. Accordingly, the ratio of styrene to maleic anhydride in the copolymers may be in the range of from about 96:4 to about 75:25, preferably from about 94:6 to about 90:10. Processes for preparing these copolymers are well known in the art.

The dispersing medium used in the fiber-forming step of the process of this invention contains an organic solvent which is a nonsolvent at its normal boiling point for the styrene-maleic anhydride used to form the fibers. It may be the hexane shown in the examples, or other aliphatic hydrocarbons such as butane, pentane, heptane, octane and their isomers. Also useful are aromatic hydrocarbons such as benzene, toluene and xylene; alicyclic hydrocarbons such as cyclohexane; and halogenated hydrocarbons such as methylene chloride, chloform, carbon tetrachloride, methyl chloride, ethyl chloride, trichlorofluoromethane and 1,1,2-trichloro-1,2,2-trifluoroethane. Mixtures of these solvents may be used, and water desirably is present to form an emulsion of the copolymer. The pressure generated by the solvent and water vapors may be, and normally will be, augmented by a pressurized inert gas such as nitrogen or carbon dioxide.

In carrying out the fiber-forming process, the concentration of the styrene-maleic anhydride copolymer in dispersion in the dispersing medium normally will be from about 5 to about 40% by weight, preferably from about 10 to about 30% by weight. The temperature to which the dispersion of the copolymer is heated will generally be in the range of from about 100° to about 225° C. The pressure on the dispersion of the copolymer may be from about 500 to about 1500 p.s.i., but preferably is in the range of from about 900 to about 1200 p.s.i. The orifice through which the copolymer composition is discharged should have a diameter of from about 0.5 to about 15 mm., preferably from about one to about five mm., and the ratio of the length of the orifice to its diameter should be from about 0.2 to about 10.

In the fiber-modifying step of the process of this invention, the fibers of the fibrous styrene-maleic anhydride copolymer composition are disc refined in a dilute aqueous admixture of certain cationic and anionic nitrogen-containing polymers, resulting in the deposition on the fibers of from about one to about 15% by weight of the admixture, based on the weight of the fibrous composition. The ratio of the cationic to the anionic polymer in the admixture of these polymers preferably is in the range of from about 1:3 to about 1:7 by weight. The cationic polymer component of the aforementioned blend may generally be classified as the reaction product of epichlorohydrin and a polymer containing secondary or tertiary amine groups, or both. One representative group of polymers belonging to this defined class may be exemplified by the cationic polymer component used in many of the examples, namely, the reaction product of epichlorohydrin and the aminopolyamide derived from diethylenetriamine and adipic acid. Preparation of this product is shown in Example A. However, more generally, this group of cationic polymers are the reaction products of epichlorohydrin and an aminopolyamide derived from a dicarboxylic acid and a polyalkylenepolyamine having two primary amine groups and at least one secondary or tertiary amine group.

Particularly suitable dicarboxylic acids are diglycolic acid and saturated aliphatic dicarboxylic acids containing from 3 through 10 carbon atoms such as malonic acid, succinic acid, glutaric acid, adipic acid, pimelic acid, suberic acid, azelaic acid, and sebacic acid. Other suitable dicarboxylic acids include terephthalic acid, isophthalic acid, phthalic acid, maleic acid, fumaric acid, itaconic acid, glutaconic acid, citraconic acid, and mesaconic acid. The available anhydrides of the above acids can be used in preparing the water-soluble aminopolyamide as well as the esters of the acids. Mixtures of two or more dicarboxylic acids, their anhydrides, and their esters can be used to prepare the water-soluble aminopolyamides, if desired.

A number of polyalkylene polyamines, including polyethylene polyamines, polypropylene polyamines, polybutylene polyamines and the like can be employed. Polyalkylene polyamines can be represented as polyamines in which the nitrogen atoms are linked together by groups of the formula $—C_nH_{2n}—$ where n is a small integer greater than unity and the number of such groups in the molecule ranges from two up to about eight. The nitrogen atoms can be attached to adjacent carbon atoms in the group $—C_nH_{2n}—$ or to carbon atoms farther apart, but not to the same carbon atom. Polyamines such as diethylenetriamine, triethylenetetramine, tetraethylenepentamine, and dipropylenetriamine, which can be obtained in reasonably pure form are suitable for preparing water-soluble aminopolyamides. Other polyalkylene polyamines that can be used include methyl bis-(3-aminopropyl)amine; methyl bis-(2-aminoethyl)amine; and 4,7-dimethyltriethylenetetramine. Mixtures of polyalkylene polyamines can be used, if desired.

The spacing of an amino group on the aminopolyamide can be increased if desired. This can be accomplished by substituting a diamine such as ethylenediamine, propylenediamine, hexamethylenediamine and the like for a portion of the polyalkylene polyamine. For this purpose, up to about 80% of the polyalkylene polyamine can be replaced by a molecularly equivalent amount of diamine. Usually, a replacement of about 50% or less will be adequate.

The temperatures employed for carrying out the reaction between the dicarboxylic acid and the polyalkylenepolyamine may vary from about 110° C. to about 250° C. or higher at atmospheric pressure. For most purposes, however, temperatures between about 160° C. and 210° C. have been found satisfactory and are preferred. Where reduced pressures are employed, somewhat lower temperatures may be utilized. The time of reaction depends on the temperatures and pressures utilized and will ordinarily vary from about one-half to two hours, although shorter or longer reaction times may be utilized depending on reaction conditions. In any event, the reaction is desirably continued to substantial completion for best results.

In carrying out the reaction, it is preferred to use an amount of dicarboxylic acid sufficient to react substantially completely with the primary amine groups of the polyalkylenepolyamine but insufficient to react with the secondary and/or tertiary amine groups to any substantial extent. This will usually require a mole ratio of polyalkylenepolyamine to dicarboxylic acid of from about 0.9:1 to about 1.2:1. However, mole ratios of from about 0.8:1 to about 1.4:1 may be used with quite satisfactory results. Mole ratios outside of these ranges are generally unsatisfactory. Thus, mole ratios below about 0.8:1 result in a gelled product or one having a pronounced tendency to gel while mole ratios about 1.4:1 result in low molecular weight polyamides. Such products when reacted with epichlorohydrin, do not produce resins having the desired efficiency for use herein.

In converting the aminopolyamide, formed as above described, to a cationic thermosetting resin, it is reacted with epichlorohydrin at a temperature from about 45° C. to about 100° C. and preferably between about 45° C. and 70° C. until the viscosity of a 20% solids solution at 25° C. has reached about C or higher on the Gardner scale. This reaction is preferably carried out in aqueous solution to moderate the reaction. pH adjustment is usually not necessary. However, since the pH decreases during the polymerization phase of the reaction it may be desirable, in some cases, to add alkali to combine with at least some of the acid formed.

When the desired viscosity is reached, sufficient water is then added to adjust the solids content of the resin solution to the desired amount, i.e., about 10% more or less, the product cooled to about 25° C. and then stabilized by adding sufficient acid to reduce the pH at least to about 6 and preferably to about 5. Any suitable acid such as hydrochloric, sulfuric, nitric, formic, phosphoric and acetic acid may be used to stabilize the product. However, sulfuric acid is preferred.

In the aminopolyamide-epichlorohydrin reaction, it is preferred to use sufficient epichlorohydrin to convert all secondary amine groups to tertiary amine groups. However, more or less may be added to moderate or increase reaction rates. In general, satisfactory results may be obtained utilizing from about 0.5 mole to about 1.8 moles of epichlorohydrin for each secondary or tertiary amine group of the aminopolyamide. It is preferred to utilize from about 1.0 mole to about 1.5 moles for each secondary amine group of the aminopolyamide.

Another representative group of polymers belonging to the broadly defined class of cationic polymers is that wherein the polymers are water-soluble reaction products of epichlorohydrin and a polyalkylene polyamine. The preparation of an exemplary product from this group is shown in Example B.

Polyalkylene polyamines which can be reacted with epichlorohydrin have the formula $H_2N(C_nH_{2n}NH)_xH$ wherein n is an integer 2 through 8 and x is an integer 2 or more, preferably 2 through 6. Examples of such polyalkylene polyamines are the polyethylene polyamines, polypropylene polyamines and polybutylene polyamines. Specific examples of these polyalkylene polyamines include diethylenetriamine, triethylenetetramine, tetraethylenepentamine, bis(hexamethylene)triamine and dipropylenetriamine. Other polyalkylene polyamines that can be used include methyl bis(3-aminopropyl)amine; methyl bis(2-aminoethyl)amine; and 4,7-dimethyltriethylenetetramine. Mixtures of polyalkylene polyamines can be used if desired.

The relative proportions of polyalkylene polyamine and epichlorohydrin employed can be varied depending upon the particular polyalkylene polyamine used. In general, it is preferred that the molar ratio of epichlorohydrin to polyalkylene polyamine be in excess of 1:1 and less than 4.5:1. In the preparation of water-soluble resin from epichlorohydrin and tetraethylenepentamine, good results are obtained at molar ratios of from about 1.4:1 to 1.94:1. Reaction temperature is preferably in the range of from about 40° to about 60° C.

A further group of cationic polymers useful in accordance with this invention is that in which the polymers are the reaction products of epichlorohydrin and a poly(diallylamine). The preparation of such a product is shown in Example C. The poly (diallylamine) is a linear polymer having units of the formula:

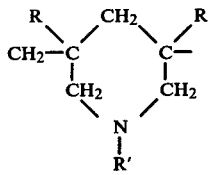

where R is hydrogen or lower alkyl and R' is hydrogen, alkyl or a substituted alkyl group.

Polymers having units of the above formula are obtained by polymerizing the hydrohalide salt of a diallylamine having the formula:

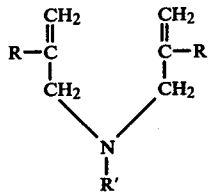

in which R and R' are as indicated above, in the presence of a free radical catalyst and then neutralizing the salt to give the polymer free base. In both of the above formulae, each R can be the same or different, and, as stated, can be hydrogen or lower alkyl. The alkyl groups contain from 1 to 6 carbons and are preferably methyl, ethyl, isopropyl or n-butyl. R' of the formula represents hydrogen, alkyl or substituted alkyl groups. The R' alkyl groups will contain from 1 to 18 carbon atoms (preferably from 1 to 6 carbon atoms) such as methyl, ethyl, propyl, isopropyl, butyl, tert-butyl, hexyl, octyl, decyl, dodecyl, tetradecyl, and octadecyl. R' can also be substituted alkyl group. Suitable substituents include, in general, any group which will not interfere with polymerization through a vinyl double bond. Typically, the substituents can be carboxylate, cyano, ether, amino (primary, secondary or tertiary), amide, hydrazide and hydroxyl.

Specific hydrohalide salts of the diallylamines which can be polymerized to provide the polymer units of the invention include diallylamine hydrochloride; N-methyldiallylamine hydrochloride; N-methyldiallylamine hydrobromide; 2,2'-dimethyl-N-methyldiallylamine hydrochloride; N-ethyldiallylamine hydrobromide; N-isopropyldiallylamine hydrochloride; N-n-butyldiallylamine hydrobromide; N-tert-butyldiallylamine hydrochloride; N-n-hexyldiallylamine hydrochloride; N-octadecyldiallylamine hydrochloride; N-acetamidodiallylamine hydrochloride; N-cyanomethyldiallylamine hydrochloride; N-β-propionamidodiallylamine hydrobromide; N-carboethoxymethyldiallylamine hydrochloride; N-β-methoxyethyldiallylamine hydrobromide; N-β-aminoethyldiallylamine hydrochloride; N-hydroxyethyldiallylamine hydrobromide; and N-acetohydrazide substituted diallylamine hydrochloride.

Diallylamines and N-alkyldiallylamines, used to prepare the polymers employed in this invention can be prepared by the reaction of ammonia or a primary amine with an allyl halide. Thus, for example, N-methyldiallylamine can be prepared by reaction of two moles of an allyl halide, such as allyl chloride, with one mole of methylamine.

In preparing the diallylamine polymers, reaction can be initiated by redox catalytic system. In a redox system, the catalyst is activated by means of a reducing agent which produces free radicals without the use of heat. Reducing agents commonly used are sodium metabisulfite and potassium metabisulfite. Other reducing agents include water-soluble thiosulfates and bisulfites, hydrosulfites and reducing salts such as the sulfate of a metal which is capable of existing in more than one valence state such as cobalt, iron, manganese and copper. A specific example of such a sulfite is ferrous sulfate. The use of a redox initiator system has several advantages, the most important of which is efficient polymerization at lower temperatures. Conventional peroxide catalysts such as tertiary-butyl hydroperoxide, potassium persulfate, hydrogen peroxide, and ammonium persulfate used in conjunction with the above reducing agents or metal activators, can be employed.

In the reaction of the poly(diallylamine) with epichlorohydrin, the latter is used in an amount ranging from about 0.5 mole to about 1.5 moles, preferably from about one mole to about 1.5 moles, per mole of secondary plus tertiary amine present in the polymer. The reaction is carried out at a temperature of from about 30° to about 80° C., preferably from about 40° to about 60° C., until the viscosity measured at 25° C. on a solution containing 20 to 30% solids is in the range of A to E, and preferably C to D, on the Gardner scale. The reaction preferably is carried out in aqueous solution to moderate the reaction, and at a pH of from about 7 to about 9.5. When the desired viscosity is reached, sufficient water is added to adjust the solids content of the resin solution to about 25% or less, and the solution is cooled to room temperature. The poly(diallylamine)-epichlorohydrin product can be stabilized against gelation by adjusting the pH of the solution to about 2 with, for example, sulfuric or hydrochloric acid.

The final group of cationic polymers used in accordance with this invention is that wherein the polymers are the reaction products of epichlorohydrin and a polyaminourylene. The preparation of one of these products is given in Example D.

The polyaminourylenes are water-soluble materials containing tertiary amine groups and/or mixtures of tertiary amine groups with primary and/or secondary amine groups and/or quaternary ammonium groups. However, tertiary amine groups should account for at least 70% of the basic nitrogen groups present in the polyaminourylene. These polyaminourylenes may be prepared by reacting urea with certain polyamines containing tertiary amine groups. The reaction can, if desired, be carried out in a suitable solvent such as xylene.

The polyamine reactant should have at least three amine groups, at least one of which is a tertiary amine group. It may also have secondary amine groups in limited amounts. Typical polyamines of this type suitable for use as hereinabove described are methyl bis(3-aminopropyl)amine, methyl bis(2-aminoethyl)amine, N-(2-aminoethyl)piperazine, and 4,7-dimethyltriethylenetetramine in reasonably pure form, or mixtures containing one or more of such materials.

The temperatures employed for carrying out the reaction between the urea and the polyalkylene polyamine may vary from about 125° C. to about 250° C. at atmospheric pressure. For most purposes, however, temperatures between about 175° C. and about 225° C. have been found satisfactory and are preferred. The time of reaction will vary depending upon the temperature, but will usually be from about one-half hour to about four hours. In any event, the reaction is desirably continued to substantial completion for best results. In carrying out the reaction between the urea and the polyamine, it is preferred to use a mole ratio of polyamine to urea of about 1:1. However, mole ratios from about 0.7:1 to about 1.5:1 can be used.

In converting the polyaminourylene, formed as above described, to a cationic thermosetting resin, it is reacted with epichlorohydrin at a temperature of from about 25° C. to about 80° C., and preferably at a temperature of from about 35° C. to about 50° C., until the viscosity of a 25% solids solution at 25° C. has reached about B or higher or the Gardner scale. This reaction is preferably carried out in aqueous solution at solids concentrations of from about 20% to about 50% to moderate the reaction. The reaction may also be moderated by decreasing the pH of the aqueous polyaminourylene solution with acid prior to addition of epichlorohydrin or immediately after the addition of epichlorohydrin. This adjustment is usually made to a pH of 8.5–9.5 but may be made to as low as a pH of 7.5 in some cases with quite satisfactory results.

When the desired viscosity is reached, the product is cooled to about 25° C. Since the product is stable on both the acid and alkaline sides, pH adjustment is not necessary. However, if desired, the pH may be adjusted to at least as low as 7.0 by the addition of sulfuric or other acid.

In the polyaminourylene-epichlorohydrin reaction, it is preferred to use a mole ratio of epichlorohydrin to free amine groups in the polyaminourylene of from about 1.0:1 to about 1.7:1. However, more or less may be added to moderate or increase reaction rates. In general, satisfactory results may be obtained utilizing from about 0.8 mole to about 2.0 moles of epichlorohydrin for each free amine group of the polyaminourylene.

The polymers which are useful as the anionic polymer component of the aqueous solution or dispersion in which the fibers of the fibrous styrene-maleic anhydride copolymer composition are modified also have been illustrated in the examples. One of these is the reaction product of glyoxal and the polyacrylamide obtained by copolymerization of acrylamide with acrylic acid. The preparation of an exemplary product is shown in Example E. The amount of acrylic acid units in the copolymer may be from about two to about 15%. Comparable products can be prepared by partial hydrolysis of polyacrylamide or a poly(acrylamide-co-alkyl acrylate) such as a copolymer of acrylamide with ethyl acrylate. Any of these polyacrylamides can be prepared by conventional methods for the polymerization of water-soluble monomers and preferably have molecular weights less than about 25,000, for example, in the range of from about 10,000 to about 20,000.

The other anionic, nitrogen-containing polymer shown in the examples is the reaction product of glyoxal and the polymer obtained by partial hydrolysis of a branched, water-soluble poly(β-alanine). Preparation of a representative product is shown in Example F. The poly(β-alanine) is prepared by the anionic polymerization of acrylamide in the presence of a basic catalyst and a vinyl or free-radical polymerization inhibitor, and the polymer will have a molecular weight in the range of from about 500 to about 10,000, preferably from about 2000 to about 6000. Because of the extremely exothermic nature of the anionic polymerization, it is preferred to conduct the reaction in a suitable organic reaction medium inert to the reaction conditions and capable of dissolving or slurrying acrylamide. Suitable media include aromatic and aliphatic compounds, for example, toluene, xylene, tetrahydronaphthalene, chlorobenzene, nitrobenzene and dioxane. The concentration of the acrylamide monomer in the reaction medium is in the range of from about two to about 30%, and is preferably from about eight to about 15%. If desired, an organosoluble polymeric dispersing agent can be added to the reaction mixture prior to the addition of the basic catalyst. When the dispersing agent is employed, the poly(β-alanine) produced is in powdered or bead form, easily filterable from the reaction medium. Suitable dispersing agents are styrene-butadiene copolymers, polyisoprene, chlorinated polypropylene, chlorinated and maleated polyisoprene and chlorinated and maleated polyolefins.

Illustrative basic catalysts which can be employed include alkali metals, alkali metal hydroxides, alkaline earth metal hydroxides, quaternary ammonium hydroxides and the alkali metal alkoxides. Specific examples of suitable basic catalysts are sodium, sodium hydroxide, lithium hydroxide, potassium hydroxide, sodium t-butoxide, sodium methoxide, tetramethylammonium hydroxide, potassium t-butoxide and calcium hydroxide. The amount of catalyst used is in the range of about 0.01 to about 2.0 mole %, preferably about 0.1 to about 1.5 mole %, based on the monomer. A free radical inhibitor is added to the reaction mixture to inhibit vinyl polymerization through the double bond of the acrylamide monomer. Examples of free radical inhibitors which can be used are phenyl-β-naphthylamine, hydroquinone, diphenylamine and phenothiazine. The polymerization reaction is conducted at temperatures in the range of from about 40° to about 140° C. and preferably from about 80° to about 130° C. In some cases, the anionic polymerization of acrylamide under the preceding conditions will produce a mixture of water-soluble and water-insoluble poly(β-alanine). The water-soluble polymer can be readily separated by partially dissolving the polymer product in water and removing the insoluble fraction by conventional methods such as filtration.

The branched poly(β-alanine) produced as described above is a neutral polymer and needs to be anionically modified for the purpose of this invention. Anionic modification of branched poly(β-alanine) can be accomplished by partial hydrolysis of the polymer to convert some of the primary amide groups into anionic carboxyl groups. For example, hydrolysis of poly(β-alanine) can take place by heating a slightly basic aqueous solution of the polymer having a pH of about 9 to 10 at temperatures of about 50° to about 100° C. The amount of anionic groups introduced should be from about one to about ten mole percent, and preferably about two to about five mole percent, based on amide repeating units.

Each of the anionic, nitrogen-containing polymers described above is modified with glyoxal to provide the desired anionic, water-soluble, nitrogen-containing polymers used in accordance with this invention. The reaction with glyoxal is carried out in a dilute neutral or slightly alkaline aqueous solution of the polymer at a temperature of from about 10° to about 50° C., preferably from about 20° to about 30° C. The concentration of the polymer in the solution may be from about five to about 40% by weight, but preferably is from about seven to about 20%. The amount of glyoxal used in the reaction mixture may be from about 10 to about 100 mole percent, preferably from about 20 to about 30 mole percent, based on amide repeat units in the polymer. The reaction is allowed to continue until a viscosity increase of from about two to about ten, preferably from about four to about six, units on the Gardner scale has taken place. This increase in viscosity is indicative that some crosslinking of the polymer has desirably taken place, but this amount of crosslinking is insufficient to cause gelation. The reaction then is terminated, usually by dilution of the reaction mixture with water and addition of sulfuric acid to lower the pH to about 4.5–5.0. The resulting solutions possess good stability.

The process of this invention makes possible the preparation of improved paper products from blends of wood pulp and styrene-maleic anhydride copolymer pulps. The process depends upon the particular combination of cationic and anionic nitrogen-containing polymers used to modify the fibers in the disc refining step of the process. Moreover, the process depends upon several critical factors, namely, a molecular weight of at least 10,000 for the styrene-maleic anhydride copolymer, sufficient available carboxyl in the copolymer and sufficient resin in the aqueous solution or dispersion in which the anionic copolymer fibers are modified. However, operation within the limits of these conditions makes it possible to produce a synthetic pulp which, when blended with wood pulp, will provide a paper product having at least 80% of the tensile strength of 100% wood pulp, as well as improved brightness, opacity, smoothness and printability at low sheet weights compared with conventional filled or unfilled paper.

What I claim and desire to protect by Letters Patent is:

1. A process for the preparation of a fibrous pulp containing hydrophilic synthetic polymer fibers which comprises disc refining a spurted fibrous styrene-maleic anhydride copolymer composition in a dilute aqueous admixture of water-soluble nitrogen-containing cationic and anionic polymers, such cationic polymer being the reaction product of epichlorohydrin and (a) an aminopolyamide derived from a dicarboxylic acid and a polyalkylene polyamine having two primary amine groups and at least one secondary or tertiary amine group, or (b) a polyalkylene polyamine having the formula $H_2N(C_nH_{2n}NH)_xH$, wherein n is an integer 2 through 8 and x is an integer 2 or more, or (c) a poly(diallylamine) or (d) a polyaminourylene derived from urea and a polyamine having at least three amine groups, at least one of which is tertiary, and said anionic polymer being the reaction product of glyoxal and (a) a polyacrylamide containing from about 2 to about 15% acrylic acid units or (b) a partially hydrolyzed, branched poly(β-alanine) containing from about 1 to about 10 mole percent carboxyl groups based on amide repeating units, the ratio of said cationic polymer to said anionic polymer in said admixture of said polymers being in the range of from about 1:3 to about 1:7 by weight and the amount of said admixture of said polymers deposited on the fibers of said fibrous composition being from about one to about 15% by weight based on said fibrous composition.

2. The process of claim 1 wherein the spurted fibrous styrene-maleic anhydride copolymer has a styrene to maleic anhydride ratio which is in the range of from about 96:4 to about 75:25.

3. The process of claim 1 wherein the spurted fibrous styrene-maleic anhydride copolymer has a molecular weight in the range of from about 10,000 to about 300,000.

4. The process of claim 1 wherein the cationic, water-soluble, nitrogen-containing polymer is the reaction product of epichlorohydrin and an aminopolyamide derived from a dicarboxylic acid and a polyalkylene polyamine two primary amine groups and at least one secondary or tertiary amine group.

5. The process of claim 4 wherein the aminopolyamide is derived from adipic acid and diethylenetriamine.

6. The process of claim 5 wherein the anionic, water-soluble, nitrogen-containing polymer is the reaction product of glyoxal and the polyacrylamide obtained by copolymerization of acrylamide with acrylic acid.

7. The process of claim 5 wherein the anionic, water-soluble, nitrogen-containing polymer is the reaction product of glyoxal and the polymer obtained by partial hydrolysis of a branched, water-soluble poly(β-alanine).

* * * * *

UNITED STATES PATENT AND TRADEMARK OFFICE

CERTIFICATE OF CORRECTION

PATENT NO. : 4,154,646

DATED : May 15, 1979

INVENTOR(S) : Terence W. Rave

It is certified that error appears in the above-identified patent and that said Letters Patent are hereby corrected as shown below:

Col. 2, line 63, "240" should read --420--.

Col. 13, line 17, the second "or" should read --on--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*